United States Patent [19]

Kizawa

[11] Patent Number: 4,706,238

[45] Date of Patent: Nov. 10, 1987

[54] CLOCK

[75] Inventor: Hiroyuki Kizawa, Tokyo, Japan

[73] Assignee: Seikosha Co., Ltd., Tokyo, Japan

[21] Appl. No.: 876,374

[22] Filed: Jun. 19, 1986

[30] Foreign Application Priority Data

Jun. 19, 1985 [JP] Japan ..... 60-92487[U]

[51] Int. Cl.[4] ..... G04B 37/00

[52] U.S. Cl. ..... 368/296; 368/276; 368/223; 368/228

[58] Field of Search ..... 368/223, 228, 229, 232, 368/234, 236, 276, 309, 314, 316, 327, 296

[56] References Cited

U.S. PATENT DOCUMENTS

| | | | |
|---|---|---|---|
| 1,036,485 | 8/1912 | Greenwald | 368/234 |
| 1,319,044 | 10/1919 | Cohan | 368/236 |
| 3,514,940 | 2/1970 | Keane, Jr. et al. | 368/234 |
| 4,291,401 | 9/1981 | Bachmann | 368/236 |
| 4,362,397 | 12/1982 | Klingenberg | 368/234 |
| 4,459,032 | 7/1984 | Musy | 368/234 |
| 4,472,068 | 9/1984 | Sedlak et al. | 368/234 |

FOREIGN PATENT DOCUMENTS

| | | | |
|---|---|---|---|
| 482923 | 9/1929 | Fed. Rep. of Germany | 368/236 |
| 893410 | 12/1944 | Fed. Rep. of Germany | 368/232 |
| 203477 | 3/1939 | Switzerland | 368/236 |

*Primary Examiner*—Bernard Roskoski

*Attorney, Agent, or Firm*—Bruce L. Adams; Van C. Wilks

[57] ABSTRACT

A clock comprising capsule in which a timepiece movement is incorporated, a install plate on which the capsule is fixedly attached, a dial disposed in front of the install plate, a transparent front cover disposed in front of the dial, and hands disposed in a gap between the front cover and the dial and driven by said movement, characterized in that projections are integrally formed on the front cover so that tip ends of the projections are made to come to close to or to abut against a front surface of the dial.

8 Claims, 3 Drawing Figures

CLOCK

BACKGROUND OF THE INVENTION

The present invention relates to a clock such as a hanging clock, or the like, and particularly relates to a thin clock.

In a structure of a well-known clock, a dial is disposed in front of an install plate on which a movement capsule is fixedly attached, a transparent front cover is disposed in front of the dial, and hands are disposed between the front cover and the dial. A setting shaft for correcting time is disposed on the back side of the install plate. Recently, a clock has been much desired to be light, thin and small, so that it has been an extremely important technical problem to make the clock thin. Under such circumstances, the distance between the dial and the front cover is made extremely narrow, and, further, the front cover, the dial, the install plate, and even the hands per se have been formed extremely thin to the extent that the strength of the clock is not detrimentally affected.

As the result, the install plate and the front cover have come to be easily deformed due to temperature changes, due to pressure applied in turning the hands, and so on, so as to generate a phenomenon that the front cover touches the hands, especially, a minute hand, so that the minute hand becomes dislodged from a minute hand shaft to thereby stop, or the front cover is rubbed and becomes damaged by the minute hand, or, in the worst case, the clock stops completely.

SUMMARY OF THE INVENTION

An object of the present invention is therefore to provide a clock in which the gap between the front cover and dial can be kept fixed even if the install plate of the movement capsule or the front cover is made to be deformed.

The present invention is featured in that projections are integrally formed on the front cover so that tip ends of the projections are made to come to close to or to abut against a front surface of the dial.

Accordingly, even if the front cover is subject to be deformed due to a temperature, a pressure applied during operation, or the like, the gap between the front cover and the dial is kept fixed by the projections so as to prevent the front cover from touching the hands.

DETAILED DESCRIPTION OF PREFERRED EMBODIMENTS

Figure 1:
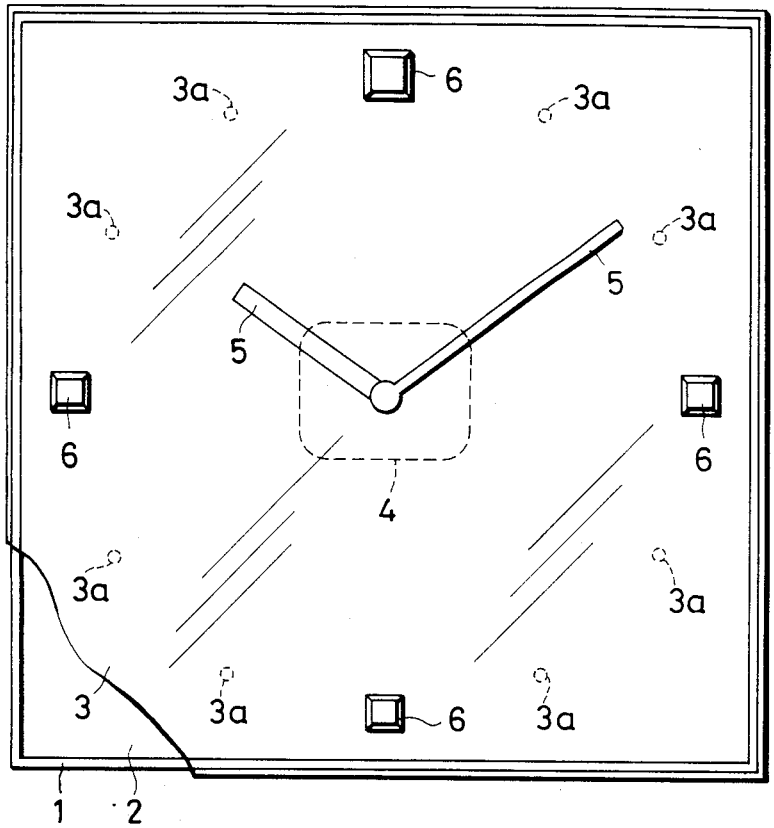
FIG. 1 is a front view of a clock constructed according to the present invention.

Referring to the drawings, preferred embodiments according to the present invention will be described.

Figure 2:
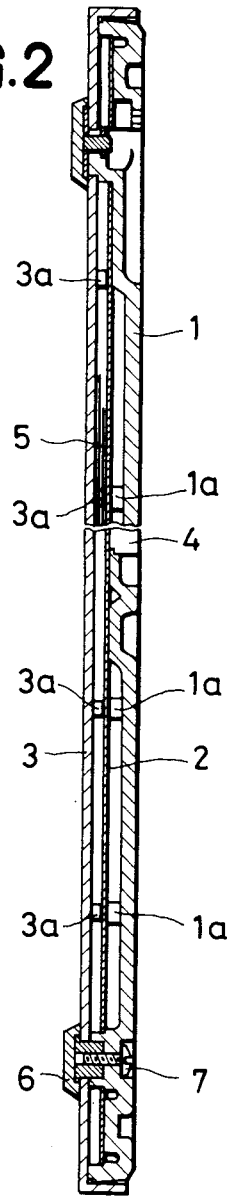
FIG. 2 is a partially cut-away enlarged cross-section.

As shown in FIGS. 1 and 2, a thin clock according to the present invention is constituted by an install or base plate 1 used also as a back frame, a dial 2, a transparent front cover 3, and a movement capsule 4. Hands 5 driven by a well-known timepiece movement (not-shown) provided in the capsule 4 are disposed in a gap or space between the dial 2 and the front cover 3. Decorations 6 and 6*a* used also as indicating members are fixedly attached on the front surface of the front cover 3. Screws 7 inserted into the install plate 1 from its back face are screwed into the back surfaces of the decorations 6 so that the front cover 3 and the install plate 1 are connected with each other through the dial 2 interposed therebetween.

Figure 3:
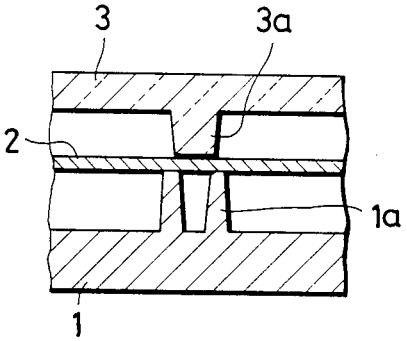
FIG. 3 is an enlarged cross-section of a main part of the clock.

As clearly shown in FIGS. 2 and 3, spaced means in the form of projections 3*a* are integrally formed on the front cover 3 at positions in the visible peripheral portion of the transparent front cover 3 such that the hands 5 are not prevented from turning. The lower ends of the respective projections 3*a* are made to come close to or abut against the front surface of the dial 2 such that the projections 3*a* are contactable with the front face of the dial 2 to maintain a sufficient gap or space. Further, the projections 3*a* are arranged to define a time scale for the hands 5 as shown in FIG. 1. Accordingly, even if the front cover 3 or the like is deformed due to a temperature or a pressure applied in operating to turn the hands, the gap or distance between the front cover and the dial is kept fixed by the projections 3*a* so as to prevent the front cover from touching the hands 5.

As shown in FIG. 3, hollow projections 1*a* are projectingly provided on the install plate 1 at the front surface thereof. Upper end surfaces of the projections 1*a* can abut against the lower surface of the dial 2 in opposed relation to the projections 3*a* to support the same, so that the dial 2 and the front cover 3 are made to be prevented from being excessively deformed.

According to the thus arranged present invention, even if the front cover and/or the movement capsule install plate is subject to be deformed due to a temperature, external force, or the like, the projections keep the gap between the front cover and the dial fixed so as to prevent the hands from being touched, to thereby prevent faults such as injury of the front cover due to touching by the hands, stopping of rotation of the hands, stopping of operation of the clock, and so on. Accordingly, it is possible to make the gap between the dial and the front cover as narrow as possible to thereby make the clock thin.

What is claimed is:

1. In a clock comprising a capsule having a timepiece movement therein, an install plate for firmly supporting said capsule thereon, a dial having a front face and being disposed in front of said install plate, a transparent front cover having a back face and being disposed in front of said dial to define a gap between the back face of the transparent front cover and the front face of the dial, and hands disposed in said gap and driven by said timepiece movement to indicate time; the improvement wherein said transparent front cover has projections integrally formed on the back face of the transparent front cover so as to come close to or abut against the front face of said dial, the projections being arranged to represent a time scale for the hands.

2. A clock comprising: a base plate having a front face; a timepiece movement disposed on the front face of the base plate; a dial having front and back faces and being disposed on the front face of the base plate; a transparent cover plate having a back face and being spaced apart a given distance from the dial to define a space between the back face of the cover plate and the front face of the dial; a clock hand disposed in the space and driven by the timepiece movement to move relative to the dial to indicate time; and spacer means integrally formed on a visible peripheral portion of the back face of the cover plate and protruding toward the front face of the dial such that the spacer means is contactable with the front face of the dial upon deformation of the cover plate and dial to thereby maintain a sufficient space to allow free movement of the clock hand.

3. A clock according to claim 2; wherein the spacer means comprises a plurality of projections.

4. A clock according to claim 3; wherein the projections are arranged to define a time scale for the clock hand.

5. A clock according to claim 2; wherein the spacer means extends in the vicinity of the front face of the dial.

6. A clock according to claim 2; wherein the spacer means protrudes into contact with the front face of the dial.

7. A clock according to claim 2; including supporting means disposed between the back face of the dial and the front face of the base plate in opposed relation to the spacer means for supporting the spacer means through the dial.

8. A clock according to claim 7; wherein the supporting means comprises a plurality of projections integrally formed on the front face of the base plate.

* * * * *